United States Patent [19]

Melnik

[11] Patent Number: 4,830,359

[45] Date of Patent: May 16, 1989

[54] SHEET COLLECTOR

[75] Inventor: Peter Melnik, Rushden, England

[73] Assignee: Xerox Corporation, Stamford, Conn.

[21] Appl. No.: 102,068

[22] Filed: Sep. 29, 1987

[51] Int. Cl.[4] ..... B65H 29/54

[52] U.S. Cl. ..... 271/306; 271/207

[58] Field of Search ..... 271/306–308, 271/312, 296, 189, 84, 207, 181, 278, 271, 269; 414/17

[56] References Cited

U.S. PATENT DOCUMENTS

| | | | |
|---|---|---|---|
| 886,743 | 5/1908 | Tyler | 101/68 |
| 2,677,542 | 5/1954 | Backhouse et al. | 271/254 |
| 3,148,879 | 9/1964 | Kistner | 271/181 |
| 3,847,388 | 11/1974 | Lynch | 271/306 |
| 4,056,264 | 11/1977 | Dhooge et al. | 271/177 |
| 4,141,546 | 2/1979 | Queener | 271/173 |
| 4,241,911 | 12/1980 | Lee | 271/307 |
| 4,290,596 | 9/1981 | Baumann | 271/292 |
| 4,444,491 | 4/1984 | Rinehart et al. | 355/50 |
| 4,474,366 | 10/1984 | Reider | 271/180 |
| 4,580,774 | 4/1986 | Yamaguchi et al. | 271/84 |

FOREIGN PATENT DOCUMENTS

| | | | |
|---|---|---|---|
| 61-136857 | 6/1986 | Japan | 271/306 |

OTHER PUBLICATIONS

Edwards et al., IBM Technical Disclosure Bulletin, vol. 22, No. 4, Sep. 1979, pp. 1372–1373.

*Primary Examiner*—H. Grant Skaggs

*Attorney, Agent, or Firm*—William A. Henry, II

[57] ABSTRACT

A sheet stacker or sorter for a xerographic or other copier has respectively one or more upwardly-inclined or vertical sheet receiving bins fed from below by nip rolls located at the exit of a pair of guide plates which direct the sheet towards the bin. The trail edge of the sheet is lifted from the exit of the guide plates onto a ledge of the bin by a scoop differentially pivoted at the end of a drive arm and a slave arm, the slave arm being limited in its pivotal excursion by pins journalled on the drive arm. With this mechanism a scoop is tipped forward when it enters the bin first depositing the sheet and then the rear wall of the scoop urges the trailing portion of the sheet into conformity against the support face of the bin for improved stacking.

4 Claims, 2 Drawing Sheets

SHEET COLLECTOR

Figure 1:
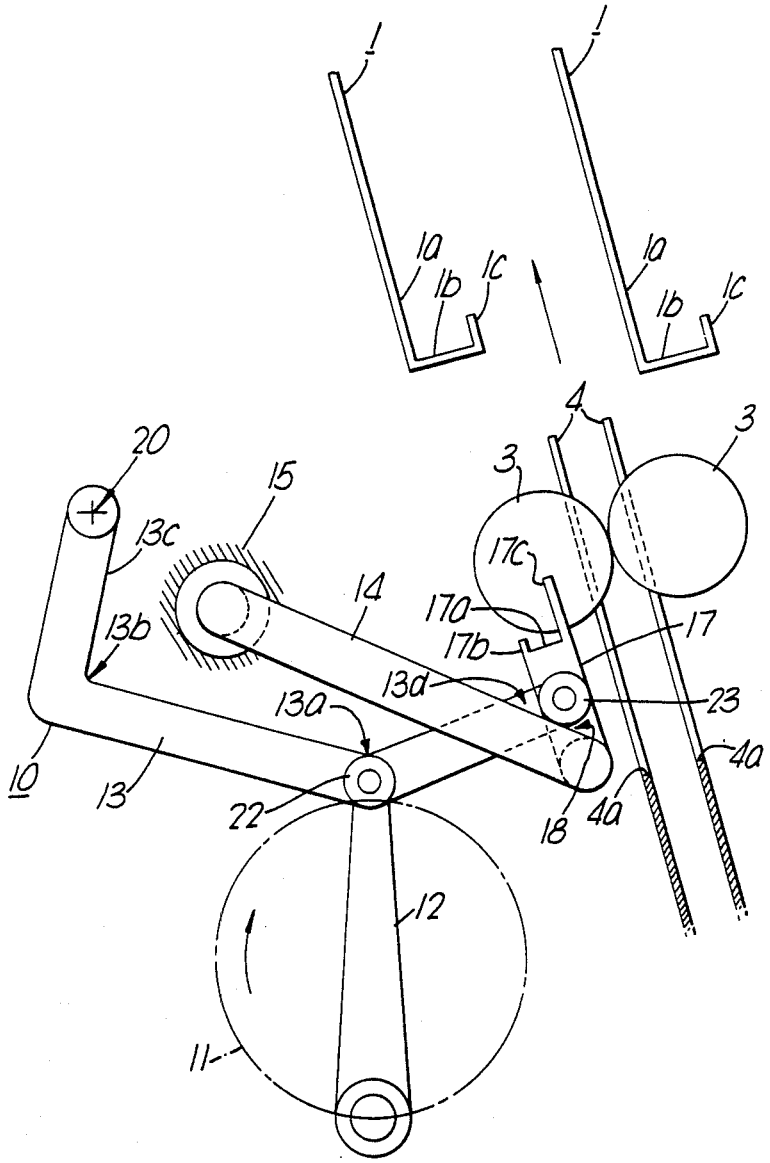

This invention relates to a sheet collector, that is to say, apparatus for stacking or sorting sheets, particularly copy sheets issuing from a xerographic or other copier, the collector comprising one or more upright bins for receiving the sheets to be collected.

Our copending patent applications U.S. Ser. No. 102,177, filed on Sept. 29, 1987, entitled "Sheet Sorters" and U.S. Ser. No. 886,583, filed on July 16, 1986, now U.S. Pat. No. 4,781,371, entitled "Sheet Collector" discloses sheet sorters having a plurality of generally upright sheet-receiving bins adapted to hold sheets in a substantially curved configuration transverse to the direction of sheet feed. In both cases, guide means are includes below the bins for directing sheets upwards into the bins. This arrangement has space saving advantages by enabling shorter bins and dispensing with sheet inverting means for 1-N copying and collating, but it does give rise to the problem of transferring the upwardly-directed sheets from the guide means into the overlaying bins. One solution is for the sheet to be imparted with sufficient momentum as it is ejected from the exit of the guide means to carry it upwards and fully into the bin unassisted by mechanical means.

In Ser. No. 886,583 entitled "Sheet Collector", however, rotating brushes with radially xtending bristles are located near the exit of the guide means whereby the bristles help to lift the trail edge of the sheet from the guide means into a bin above and thereafter to urge the trail edge of the sheet into conformity with the other sheets previously collected in the bin for improved stacking.

PRIOR ART

U.S. Pat. Nos. 4,141,546 and 4,290,596 disclose vertically oriented collectors for the output of a copier. A sheet feeding apparatus is shown in U.S. Pat. No. 2,677,542 that shows different pusher mechanisms that are used to insure that a sheet is pushed up to or kept up to a stop member. U.S. Pat. No. 4,056,264 is directed to a stack forming device that includes a rotatably driven traction surface. A portion of the trailing edge of a sheet to be stacked is kept in contact with a traction surface so that the trailing edge of the sheet is displaced in synchronism with the traction surface. This displacement is carried out after the abutment of the leading edge of the sheet against a stop provided on a stacking platform. Consequently, the sheet acquires a convex configuration and is finally propelled against the platform or preceding sheet after release by the traction surface. In U.S. Pat. No. 4,444,491, an automatic reproduction system is shown as having a document handling apparatus, copy sheet processor and a finishing station. A sorter bin array is utilized to collate copy sheets into sets. A collating bin collecting mechanism is provided for each bin which serves to pull sheets into the collating bin and aids in the registration of each sheet in a bin. In U.S. Pat. No. 4,474,366, a sheet-like article stacking machine is disclosed which employs transfer belts to move the articles upward to a stacking area in front of a pair of continuously reciprocating pusher plates. One or more pusher feet on each pusher plate apply a pushing force to each article, thereby pushing it onto a stack of articles.

According to the present invention there is provided a bottom-fed sheet collector comprising at least one upright bin for receiving the sheets, guide means for directing the sheets into the bin(s), and a scoop for lifting the trail edge of the sheets from the exit of the guide means into the bin(s).

A sheet collector in accordance with the invention has the advantage of enabling more positive sheet transfer from the guide means into the bin(s).

Preferably the scoop is pivotably mounted and means may be included for tipping the scoop forward when it is in the bin to deposit the sheet. Furthermore, the scoop may be adapted so that after it has been tipped forward it urges the trailing portion of the sheet into the bin, thus registering or conforming the sheet against the bin or against sheets previously collected therein.

An embodiment of the invention will now be described, by way of example, with reference to the accompanying drawings, in which:

FIG. 1 is a schematic sectional view of part of a sheet sorter in accordance with the invention, and FIGS. 2*a*–2*d* are diagrammatic representatons of the sorter at different stages in its operation.

FIG. 1 shows two bins 1 of an upright multi-bin sorter. Each bin comprises a front support surface 1*a* having a substantially perpendicular ledge 1*b* at its bottom edge. The ledge 1*b* has an upturned lip 1*c* at its rear edge remote from the support surface 1*a*. Adjacent bins are arranged in mutually parallel spaced apart relationship. The sorter may comprise any suitable number of bins, for example fifteen.

A pair of driven feed rolls 3 are aligned below one of the bins at the exit of a pair of guide surfaces 4 arranged for directing a sheet into the bin above the direction of the arrow substantially parallel to the support surface 1*a*. The guide surfaces 4 have recesses 4*a* through which the rolls 3 extend.

It is noted here that the copy sheets are usually expelled from the processor of a xerographic or other copier along a horizontal sheet path with copy side up, in which case the guide surfaces 4 may be curved at their lower ends (not shown) to deflect the copy sheet from its horizontal path into the upwardly inclined direction for feeding into the bin as shown in FIG. 1.

When a bin has received a copy sheet the guide surfaces 4 and the nip rolls 3 can be indexed laterally as a fixed assembly by transport means (not shown) so that subsequent copy sheets can be directed to each of the bins in turn. Alternatively, the guide and feed assembly 3, 4 can be fixed and the bins indexed.

In accordance with the invention the sorter comprises a scoop device 10 for lifting the trail edge of a copy sheet from the exit of the guide and feed assembly 3, 4 and inserting it into the bin 1 aligned above. The scoop device comprises a crank 11 with a connecting rod 12 connected at the apex of a shallow V-shaped bin 13*a* in a drive arm 13 above the crank 11. The drive arm 13 also has an L-shaped bend 13*b*, the upwardly directed leg 13*c* of the "L" being pivoted at its end about axis 20. On the other end 13*d* of the drive arm 13 there is pivotally mounted a scoop 17 comprising a flat base portion 17*a* with a front lip 17*b* and a relatively tall back support wall 17*c*. The scoop 17 has a portion 18 extending below the drive arm 13. A straight slave arm 14 is pivotaly connected at one end to the extension 18 and at the other end to a friction surface 15. The friction surface 15 stops the slave arm 14 from freely rotating. Moreover, the slave arm 14 is restricted in its excursion by two pins (or rollers) 22, 23 which are mounted on the drive arm 13 respectively at the V-shaped bend 13*b* and at the end 13*d* where the scoop 17 is connected.

The operation of the scoop mechanism will now be described with reference to FIGS. 2*a*–2*d*. For the sake of clarity the copy sheet is not shown in these figures.

Figure 2A:
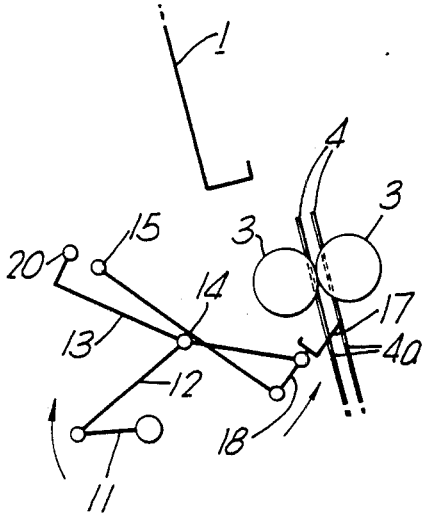
Figure 2B:
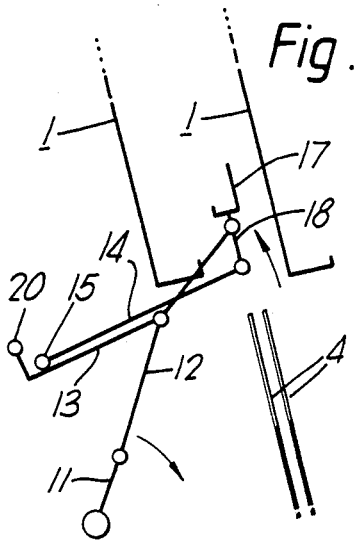
Figure 2C:
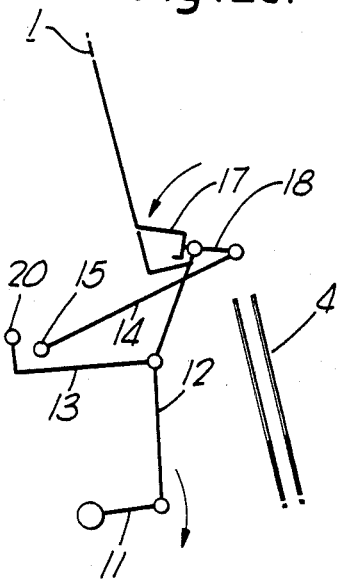

When the crank 11 is rotated almost a quarter cycle clockwise the connecting rod 12 moves into the position shown in FIG. 2*a* and the pin (or roller) 22 on the drive arm 13 engages the lower side of the slave arm 14. However, as the crank 11 continues to rotate clockwise the movement of the drive arm 13 relative to the slave arm 14 firstly causes the scoop to tilt backwards from its rest or "home" position through the aperture 4*a* in the guides 4 and into the paper path behind the trail edge of the sheet entering the bin. The pin 22 then acts to link the slave arm 14 to the drive arm 13 so that during further clockwise rotation of the crank 11 to approximately half cycle (maximum stroke) the scoop 17 is driven upwards lifting the sheet into the inter-bin gap (see FIG. 2*b*). The different pivotal axes of the drive arm 13 and the slave arm 14 are arranged such that the scoop 17 travels in a substantiallystraight line approximately parallel to the paper path as it enters the space between adjacent bins. This enables a compromise to be achieved between the minimum bin spacing and the maximum scoop clearance.

Figure 2D:
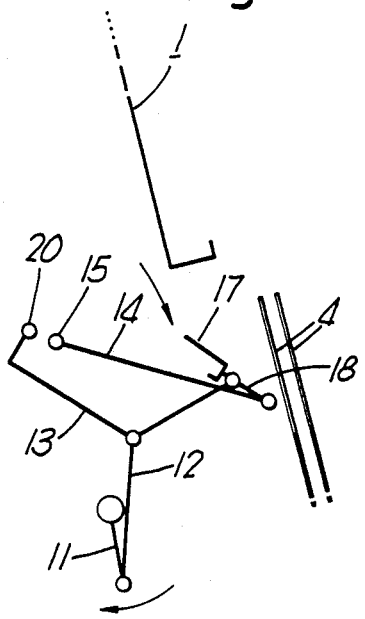

As the crank 11 continues to rotate past the half cycle (maximum stroke) the pin 22 disengages from the slave arm 14. Because of the frictional pivot mounting 15 of the slave arm 14 continued crank rotation causes the drive arm 13 to tip the scoop forward towards the bin support surface 1*a* (see FIG. 2*c*), depositing the trail edge of the copy sheet onto the ledge 1*b* of the bin 1. Continuing downward movement of the drive arm 13 causes the back wall 17*c* of the scoop 17 to urge the trailing portion of the sheet forward registering it against the support face 1*a* or against sheets already collected in the bin. The back wall of scoop 17*c* then drags the sheet downward so it is restrained by bin lip 1*c*. This happens when the pin (or roller) 23 engages the slave arm 14 pulling it downwards in its tipped position. This physical link between the drive arm 13 and the slave arm 14 then causes the scoop 17 to be returned to its rest or "home" position as shown in FIG. 2*d* as the crank 11 completes its full cycle. The whole cycle is then repeated for lifting further copy sheets into the bins, the entire scoop mechanism 10 being indexed laterally with the guide and feed assembly 3, 4 (if appropriate) for feeding the subsequent sheets into an adjacent bin.

The details of the sheet sorter described above are merely exemplary and it will be evident to a person skilled in the art that various modifications ma be made within the scope of the present invention. For example, the sheet receiving bins may be more or less inclined to the horizontal or they may be vertical. Moreover, if it is desired merely to stack and not to sort the copy sheets there need only be a single bin, and the guide means for directing sheets into the bin can then be fixed relative thereto.

What is claimed is:

1. A bottom-fed sheet collector comprising at least one upright bin for receiving the sheets, guide means for directing the sheets into said at least one upright bin, a scoop for lifting the trail edge of the sheets from the exit of the guide means into said at least one upright bin, and wherein said scoop is pivotally mounted and means for tipping said scoop forward toward a back wall of said at least one upright bin when it is in said bin to deposit a sheet from said scoop into said bin, said scoop being arranged to be moved in such a manner that after it has been tipped forward toward said back wall of said at least one upright bin it urges the trailing portion of the sheet into said at least one upright bin, means for lowering said scoop out of said at least one upright bin while said scoop remains tipped forward, said scoop being arranged to move in a substantially straight line as it travels upwards from the exit of said guide means into said at least one upright bin, and wherein said scoop is pivotally mounted at one end of a cranked drive arm, the other end of said drive arm being pivotaly mounted at a first axis, and comprising a slave arm having one end pivotally mounted to said scoop and the other end pivotally mounted at a second axis spaced apart from said first axis, said slave arm being located between two abutments to limit its pivotal movement.

2. A bottom-fed sheet collector as claimed in claim 1 wherein said abutments comprise members mounted on said drive arm.

3. A bottom-fed sheet collector as claimed in claim 2, wherein said end of said slave arm remote from the scoop is frictionally pivoted about said second axis.

4. A bottom-fed sheet collector as claimed in claim 3, wherein said drive arm is driven by a crank and linked thereto by a connecting rod.

* * * * *